US010132338B2

(12) United States Patent
Kenkel et al.

(10) Patent No.: US 10,132,338 B2
(45) Date of Patent: Nov. 20, 2018

(54) HYDRAULIC FLUID WARMUP SYSTEM AND METHOD

(71) Applicant: Deere & Company, Moline, IL (US)

(72) Inventors: Aaron R. Kenkel, East Dubuque, IL (US); Ann M. Lazare, Dubuque, IA (US)

(73) Assignee: Deere & Company, Moline, IL (US)

( * ) Notice: Subject to any disclaimer, the term of this patent is extended or adjusted under 35 U.S.C. 154(b) by 446 days.

(21) Appl. No.: 14/841,677

(22) Filed: Aug. 31, 2015

(65) Prior Publication Data

US 2017/0058922 A1 Mar. 2, 2017

(51) Int. Cl.
*F15B 21/04* (2006.01)
*F15B 11/17* (2006.01)

(52) U.S. Cl.
CPC ..... *F15B 21/042* (2013.01); *F15B 11/17* (2013.01); *F15B 2211/20546* (2013.01); *F15B 2211/20576* (2013.01); *F15B 2211/327* (2013.01); *F15B 2211/6343* (2013.01); *F15B 2211/6346* (2013.01); *F15B 2211/66* (2013.01); *F15B 2211/6652* (2013.01); *F15B 2211/6654* (2013.01)

(58) Field of Classification Search
CPC ..... Y02T 10/166; F02B 41/00
See application file for complete search history.

(56) References Cited

U.S. PATENT DOCUMENTS 6,308,516 B1 * 10/2001 Kamada ..... E02F 9/2228 60/450
7,614,223 B2 11/2009 St. Aubin et al.
7,827,785 B2 * 11/2010 Messerlie ..... F16K 49/00 60/329
8,234,860 B2 8/2012 Beschomer et al.
2006/0018765 A1 * 1/2006 Fransson ..... E02F 9/2217 417/213
2014/0193230 A1 * 7/2014 McWethy ..... E02F 9/226 414/680

* cited by examiner

*Primary Examiner* — Jelani A Smith
*Assistant Examiner* — Paul A Castro
(74) *Attorney, Agent, or Firm* — Taft Stettinius & Hollister; Stephen F. Rost

(57) ABSTRACT

In accordance with an example embodiment, a system for managing a unique hydraulic system warmup method is described. A warmup system controller is central to the system and provides an interfacing point for communication to hardware components and a machine operator. The warmup system issues commands based on sensor inputs in light of defined rules and/or known physical properties of hydraulic fluids. Hydraulic system warmup is managed by the warmup system controller, which is configured to issue commands to affect hydraulic pumps and valves. By way of a controller managed process, the system functions to maximize hydraulic system pressure and limiting release of pressures in the lines, such that the pumps are able to maintain maximum pressure for a sufficient period of time.

17 Claims, 1 Drawing Sheet

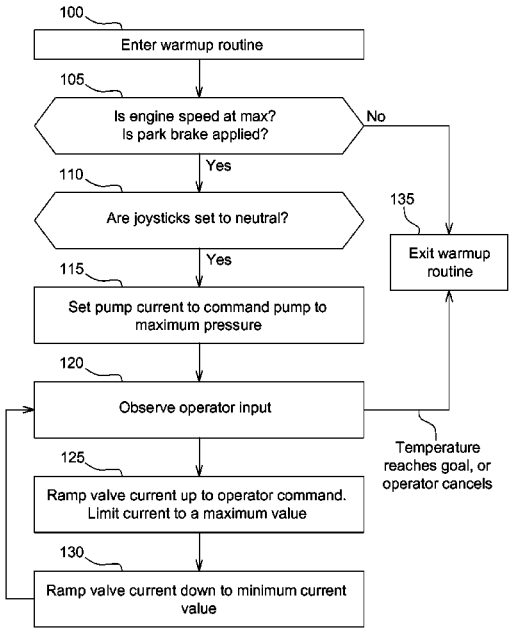

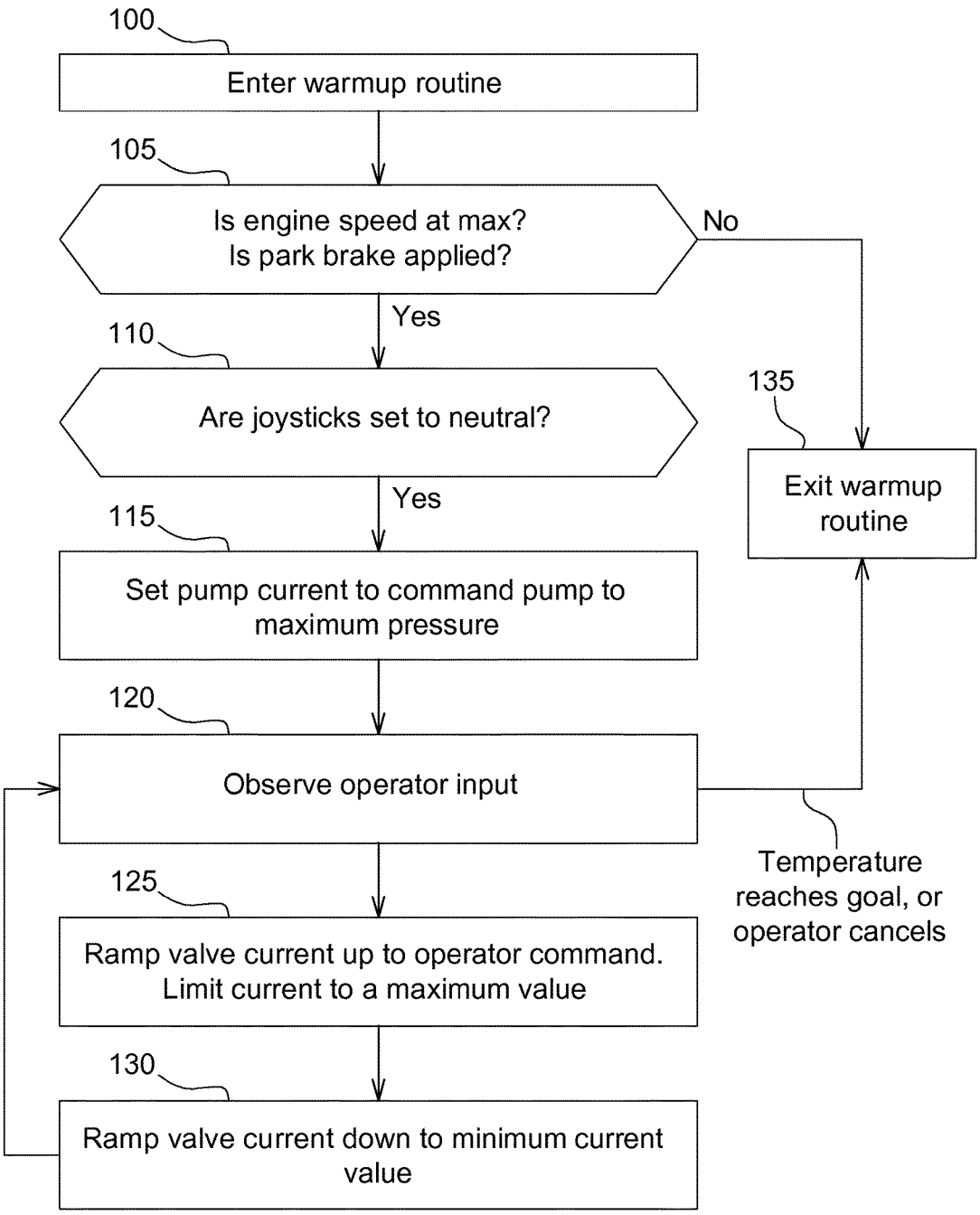
100
Enter warmup routine
105
Is engine speed at max?
Is park brake applied?
No
Yes
110
Are joysticks set to neutral?
135
Exit warmup routine
Yes
115
Set pump current to command pump to maximum pressure
120
Observe operator input
Temperature reaches goal, or operator cancels
125
Ramp valve current up to operator command. Limit current to a maximum value
130
Ramp valve current down to minimum current value

HYDRAULIC FLUID WARMUP SYSTEM AND METHOD

TECHNICAL FIELD

In general, a method and system is disclosed for warming hydraulic fluid in an electro-hydraulic pump and valve system. More specifically, the system facilitates warming of hydraulic fluid to an optimal operating temperature by at least partially retaining the fluid under pressure.

BACKGROUND

Heavy machines including, for example, dozers, loaders, excavators, motor graders, etc. typically comprise a number of hydraulic actuators to perform various functions. Actuators are fluidly connected to a pump on the machine that provides pressurized hydraulic fluid to chambers within the actuators. As the pressurized hydraulic fluid moves into or through the chambers, the pressure of the fluid acts on hydraulic surfaces of the chambers to affect movement of the actuator and a connected implement (i.e., work tool). When the pressurized fluid is drained from the chambers it is returned to a low pressure tank on the machine.

For machinery that includes a hydraulic system, it is typical practice to warm the fluid prior to valve and/or pump calibration. Also, when operating in particularly cold environments, it is often desirable or necessary to warm up the hydraulic fluid in order to improve hydraulic system performance.

In a commonly implemented hydraulic system, a single load sensing pump (or fixed displacement pump in an open center valve configuration) is utilized to provide hydraulic flow to all implemented functions on the unit. In such a system, stalling one function raises the system pressure to its relief setting. Actuating a second function causes the pump to move fluid at that relief pressure setting, thus consuming hydraulic power and heating the fluid.

In a dual pump system, pump flow may be split such that each pump independently controls an implement function. Stalling one function while actuating another does not necessarily lead to high pressure and high flow at each pump. Accordingly, for example, a first hydraulic pump may be stalled at high pressure with no flow while a second pump may move fluid at a low pressure. Neither the first pump nor the second pump consumes the power necessary for rapidly warming the hydraulic fluid.

This issue causing a lack of warming in a dual pump configuration is also applicable to other hydraulic system configurations. A single function system, for example, being controlled by a single pump may experience this issue due to not having the capability of both stalling over relief and actuating simultaneously.

SUMMARY

In general, the system and method warms hydraulic fluid within an implement that is dependent on hydraulic power (e.g., actuators, pistons, etc.). More specifically, a method is provided that enables an operator to interact with an application interface to engage, maintain and proceed with a warmup function. The warmup function is dependent on controlled pressurization and release of hydraulic pressures within a system.

The system comprises a microcontroller (i.e., warmup controller) for receiving a first fluid temperature value from a temperature sensor and determining when the fluid temperature is less than a defined minimum temperature. In response to a request by an operator, the microcontroller transmits an instruction to cause a pump controller to increase fluid pressure. Such a request may be based on, for example, a fluid temperature value falling below a defined minimum temperature. Operator interaction with an implement controller causes a command to be sent for actuating an implement, which receives power from the hydraulic pump and valve system. A rate limiting valve command is likewise sent to a valve in response to the operator's actuating command.

BRIEF DESCRIPTION OF EXEMPLARY DRAWINGS

A more complete understanding of the present invention may be derived by referring to the detailed description and claims when considered in connection with the FIGURES, wherein like reference numbers refer to similar elements throughout the FIGURES, and:

FIG. 1 is a process flow chart showing operator and system implemented steps for executing the warmup method in accordance with one embodiment.

DETAILED DESCRIPTION OF EXEMPLARY EMBODIMENTS

In a hydraulic pump system, a method to warm the hydraulic fluid includes electronically forcing a pressure compensated pump to function at full pressure by sending a high current command from a warmup system controller. The viscosity of hydraulic fluids varies with temperature changes, which creates noticeable differences in the response of hydraulically actuated implements. For example, an operator of a front-loader may observe performance differences when comparing the response of the loader's bucket having hydraulic fluid at ambient or room temperature to the performance of the loader when the hydraulic fluid has reached a normal operating temperature, typically 110° F. or higher. As such, it is common practice to operate the hydraulic main system pump for periods up to one hour prior to placing the system in operation.

Hydraulic system warmup functions may vary slightly among different types of machinery and the amount of warming required; however similar core principles remain. One such warmup function includes positioning and maintaining a control valve, such that the valve pressure port is internally connected to the fluid tank or return port. Fluid from the pump is continuously circulated in a closed loop system or via the tank is an open loop system. The flow of hydraulic fluid through the hydraulic lines and the pump eventually raise the temperature of fluid to its normal operating temperature.

Contrary to conventional warmup methods, the disclosed system and method accelerates hydraulic system warming by causing the hydraulic pumps to perform at full pressure for a period of time. More specifically, full pressure is managed by a pressure compensator, which limits pump outlet pressure to a predetermined level, while adjusting pump outlet flow to a level needed to maintain the set pressure. The pressure compensated pump will generally provide full pump flow at pressures below the compensator setting. Once the pump flow is restricted, pressure will build up to the setting of the compensator and then the pump will destroke to the level needed to maintain the compensator pressure setting. The full pressure state is maintained until the full flow capacity of the pump is satisfied.

When pressures have been established by one or more pumps, an operator is prompted by a warmup system controller, to actuate one or more machine implements, thereby causing movement of hydraulic fluid from each pump. This combination of pressure and hydraulic fluid flow causes the hydraulic system to rapidly warm to sufficient operating temperature.

The warming system controller may comprise a single microprocessor or multiple microprocessors configured to control the operation of the warmup system. The warming system controller may include proprietary hardware and software components or comprise a number of commercially available microprocessors configured to perform the functions of warming system controller. It should be appreciated that warming system controller may be readily embodied in a general machine microprocessor capable of controlling numerous machine functions. The warming system controller may include a memory, a secondary storage device, a processor, and any other components for running an application. Various other circuits may be associated with the controller such as power supply circuitry, signal conditioning circuitry, solenoid driver circuitry, and other types of circuitry.

In one embodiment, additional warming is achieved by electronically limiting the hydraulic fluid flow. The flow commanded to each function may be electronically limited in order to impose restriction to the flow of fluid (to maintain pump pressure). It may also be electronically limited in order to prevent engine stalls due to drawing too much power from the hydraulic system.

In a system with two valves for each implement (i.e., one driven by each pump), this warmup function may force both valves to open when the operator commands it. This allows pressurized fluid to move from both pumps through both valves to drive the function, more thoroughly warming the hydraulic circuit.

Depending upon system response during the operation of this warmup method, a means of rate limiting the current command to the valves may be necessary. With the pumps driven to high pressure, opening the valves may lead to aggressive function behavior. Rate limiting the valve commands will help reduce the aggressive function behavior, thereby improving operator comfort while running the procedure.

While presented herein as being specifically implemented within heavy equipment (e.g., loader, grader, backhoe, etc.), the system and method is not so limited. Those of ordinary skill in the art will appreciate that the warmup system may be applied to stationary hydraulic systems, for example, or any machine or apparatus that relies on hydraulic power to affect movement of an implement or component. Moreover, generating hydraulic pressure requires a power source (e.g., a diesel engine). However, the disclosed warmup system is not specific to any one configuration.

FIG. 1 is a process flow chart showing operator and system implemented steps for executing the warmup method in accordance with one embodiment. An application interface may be provided to enable an operator to monitor and modify parameters relating to the warmup function. The application interface may be made accessible by way of an existing display screen or a display device that is specific to the warmup system. In another embodiment, the application interface is remotely accessible, allowing an operator, manager, technician, etc. to connect to the warmup system for viewing and optionally modifying warmup parameters. In one embodiment, the application interface includes a warmup menu. The warmup menu may conveniently display the most commonly used controls and monitors for managing the warmup system and specifically to receive user selections for invoking and/or aborting the warmup function, which comprises a number of steps.

Accessing the warmup application interface by any means known in the art, an operator may be validated through a login and credential verification sequence. When secure and limited access is implemented, credential verification may be performed through any number of known or unique methods including, for example, user name and password combination, smartcard, PIN entry, biometric reading, etc. Further, a credential verification sequence may be implemented to assign user roles based on the identity of the validated user. For example, the warmup system may allow a manger to view and modify warmup parameters, while an operator may only monitor real-time parameter readings and/or view parameter settings.

When a user is allowed access to manage functions and/or parameters of the warmup system, the warmup menu may be displayed within the application interface. At any point prior to committing parameter modifications and invoking the warmup function, the operator may choose to exit or leave the warmup menu at which time; the warmup routine may be aborted. Otherwise, the warmup menu selection invokes the warmup routine.

In one embodiment, the warmup routine is engaged only after entering a warmup routine 100, which includes a number of conditional validation steps. The validation steps may include determining, for example, whether the engine speed is at maximum, park brake is applied, hydraulics are enabled, operating mode is set to performance mode and no electro-hydraulic system faults are active 105. If any of the validation steps returns false, the warmup system exits the warmup routine 135.

When a boom and boom position sensor are present, the warmup system may determine by means of position sensor feedback that the boom is resting at or near ground level. In another embodiment, the warmup system verifies that the applicable implement controller is set to a neutral position 110.

In one embodiment, a warmup routine may be invoked based on system implemented procedures, operator procedures, or any combination thereof. For example, as a procedure of the warmup routine, the warmup system may ensure that all pumps are provided a full current command 115. In order for the warmup routine to proceed, the operator may be instructed, by way of the application interface, to invoke movement of the boom and bucket (i.e., implement), which causes the hydraulic fluid to warm. Based on the instruction, the operator interfaces with an implement controller to issue a command that includes a current value 120. The command invokes implement movement.

If an operator cancels the warmup routing or when the goal temperature is obtained, the warmup system exits the warmup routine 135. Otherwise, rate limiting may be applied to the boom and bucket commands to optimize operation performance during a warmup routine. As used herein, rate limiting refers to as how quickly a valve current is raised to the operator commanded value or to a defined maximum value 125 or lowered to a defined minimum current value 130. With the pumps driven to high pressure, opening the valves may lead to aggressive function behavior. Rate limiting the valve commands may help reduce the aggressive function behavior, improving operator comfort while running the procedure. When the valve current is at the minimum value, the routine returns to monitor for operator initiated commands 120.

In one embodiment, the warmup system exits the warmup routine on completion, which is marked by a maintained hydraulic fluid temperature over a defined period of time 130. For example, the warmup routine may be considered complete and the function exited when a hydraulic temperature sensor returns values indicating that a reading of the hydraulic warmup achieved a threshold for a defined duration. Those of ordinary skill in the art will appreciate that any temperature and time parameters may be determined in accordance with a specific implementation and disclosure of such parameters herein are presented for explanation only.

The hydraulic temperature sensor may comprise a sensor, probe, or thermistor configured to measure a temperature of the hydraulic system components. In one embodiment, a hydraulic temperature sensor is a fluid sensor associated with pressurized fluid residing within or flowing past various valves, hoses, lines, motors, and actuators as described herein. The hydraulic temperature sensor may generate a signal indicative of the temperature of the hydraulic fluid and direct this signal to the warmup system controller. When the hydraulic temperature signal indicates a temperature lower than a threshold value, for example approximately 30° C., the hydraulic system may be considered to be operating in a cold condition.

The system may be described herein in terms of functional block components, optional selections and/or various processing steps. It should be appreciated that such functional blocks may be realized by any number of hardware and/or software components suitably configured to perform the specified functions. For example, the system may employ various integrated circuit components such as, memory elements, processing elements, logic elements, look-up tables, and/or the like. The integrated circuit components may carry out a variety of functions under the control of one or more microprocessors or other control devices. Similarly, software elements may be implemented with any programming or scripting language with the various algorithms being implemented with any combination of data structures, objects, processes, routines or other programming elements.

As may be appreciated by one of ordinary skill in the art, the system may be embodied as a method, a data processing system, a device for data processing, a hardware controller, and/or a computer program product. Accordingly, the system may take the form of an entirely software embodiment, an entirely hardware embodiment, or an embodiment combining aspects of both software and hardware.

Computer program code may also be stored in a computer-readable memory that may direct a computer or other programmable data processing apparatus to function in a particular manner, such that the instructions stored in the computer-readable memory produce an article of manufacture including instruction means which implement functions of flowchart block or blocks. The computer program instructions may also be loaded onto a computer or other programmable data processing apparatus to cause a series of operational steps to be performed on the computer or other programmable apparatus to produce a computer-implemented process such that the instructions which execute on the computer or other programmable apparatus include steps for implementing the functions specified in the description.

In the foregoing specification, the system has been described with reference to specific embodiments. However, it may be appreciated that various modifications and changes may be made without departing from the scope of the invention. The specification and FIGURES are to be regarded as illustrative in nature and are not intended to limit the invention to the specific steps and/or components shown and described. Accordingly, the scope of the invention should be determined by the appended claims and their legal equivalents, rather than by the examples given above. For example, the steps recited in any of the method or process claims may be executed in any order and are not limited to the order presented. Moreover, all calculations, measurements, and values disclosed herein are presented for explanation only and are not intended to limit the scope of the invention to the specific disclosures.

Benefits, other advantages, and solutions to problems have been described above with regard to specific embodiments. However, the benefits, advantages, solutions to problems, and any element(s) that may cause any benefit, advantage, or solution to occur or become more pronounced are not to be construed as critical, required, or essential features or elements of any or all the claims. As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus. Further, no element described herein is required for the practice of the invention unless expressly described as "essential" or "critical."

What is claimed is:

1. A method of controlling fluid temperature in a hydraulic system of a work machine, the machine including a controller, a user control, a temperature sensor, an electro-hydraulic pump, a control valve, and an implement, the method comprising:

detecting a fluid temperature with the temperature sensor;

executing a warmup function when the fluid temperature is below a temperature threshold, the warmup function comprising:

electronically commanding the pump to a full pressure setting;

receiving a signal from the user control to control movement of the implement;

controllably moving the control valve from a first position to a second position to allow hydraulic fluid to flow from the pump to the implement;

actuating the implement in accordance with the signal from the user control;

comparing the fluid temperature to the temperature threshold; and performing the executing step until the fluid temperature is at or above the temperature threshold for a predefined period of time;

wherein the controllably moving step comprises:

commanding an initial amount of current to the control valve from the controller, wherein the initial amount of current is less than an amount of current corresponding to the signal from the user control; and ramping the amount of current from the initial amount of current to a higher amount of current.

2. The method of claim 1, wherein the controllably moving step comprises sending an electrical command to the control valve to induce movement thereof.

3. The method of claim 2, wherein the controller limits an amount of current sent to the control valve upon receiving the signal from the user control.

4. The method of claim 1, wherein the ramping step comprises increasing the amount of current sent from the controller to the control valve from the initial amount of current to the amount of current corresponding to the signal from the user control.

5. The method of claim 1, further comprising determining if the user control is disposed in a neutral position or the implement is disposed in a threshold position.

6. The method of claim 1, further comprising validating the warmup function before the executing step.

7. The method of claim 6, wherein the validating step comprises at least one of:

(a) measuring engine speed with a speed sensor and comparing the measured engine speed to an engine speed threshold; and (b) detecting a park brake position and determining if the park brake is in an applied position.

8. The method of claim 6, wherein the executing step is not performed if one or more conditions of the validating step is not satisfied.

9. A method of controlling a hydraulic system of a work machine, the machine including a controller, a user control, a temperature sensor, a first pump, a second pump, a first control valve, a second control valve, a first implement, and a second implement, the method comprising:

detecting a temperature of hydraulic fluid in the hydraulic system with the temperature sensor;

executing a warmup function when the temperature is below a temperature threshold, the warmup function comprising:

electronically commanding the first pump and the second pump to their respective full pressure settings;

receiving a first signal and a second signal from the user control, the first signal corresponding to controlling a movement of the first implement and the second signal corresponding to controlling a movement of the second implement;

controllably moving the first control valve and the second control valve, where controlled movement of the first control valve allows fluid flow from the first pump to the first implement, and controlled movement of the second control valve allows fluid flow from the second pump to the second implement;

actuating the first implement in accordance with the first signal and the second implement in accordance with the second signal;

comparing the temperature to the temperature threshold; and performing the executing step until the temperature is at or above the temperature threshold for a predefined period of time; and maintaining the full pressure setting of both pumps until each pump reaches its respective full pump flow capacity.

10. The method of claim 9, further comprising de-stroking the first and second pumps to maintain the full pressure setting of both pumps.

11. The method of claim 9, wherein the controllably moving step comprises limiting an amount of current sent to the first and second control valves upon receiving the first and second signals from the user control.

12. The method of claim 9, wherein the controllably moving step comprises:

commanding an initial amount of current to the first or second control valve from the controller, wherein the initial amount of current is less than an amount of current corresponding to the first or second signal from the user control; and ramping the amount of current from the initial amount of current to a higher amount of current.

13. The method of claim 12, wherein the ramping step comprises increasing the amount of current sent from the controller to the first or second control valve from the initial amount of current to the amount of current corresponding to the first or second signal from the user control.

14. The method of claim 9, further comprising validating the warmup function before the executing step.

15. The method of claim 14, wherein the executing step is not performed if one or more conditions of the validating step is not satisfied.

16. A work machine, comprising:

a controller including a memory and a processor;

a hydraulic circuit containing hydraulic fluid;

a temperature sensor in electrical communication with the controller, the temperature sensor adapted to measure a fluid temperature of the hydraulic fluid in the hydraulic circuit;

a user control electrically coupled to the controller for communicating a user command thereto;

a pump fluidly coupled to the hydraulic circuit;

a control valve fluidly coupled to the pump and hydraulic circuit, the control valve being in electrical communication with the controller, where the control valve is controllably movable between at least a first position and a second position based on an electrical command from the controller;

an implement for performing a work function, the implement being in fluid communication with the control valve;

a speed sensor for measuring a speed of a power-generating device, the speed sensor being in electrical communication with the controller; and a park brake sensor for detecting a position of a park brake, the park brake sensor being in electrical communication with the controller; and a warmup function stored in the memory of the controller and being executable by the processor to electronically command the pump to a full pressure setting, receive a signal from the user control to control a movement of the implement, controllably move the control valve between the first position and the second position to allow hydraulic fluid to flow from the pump to the implement, actuate the implement in accordance with the signal from the user control, continuously monitor the fluid temperature and compare it to a temperature threshold, and exit the warmup function when the fluid temperature is at or above the temperature threshold for a predefined period of time;

wherein, the processor executes the warmup function if the speed sensor measures a speed that satisfies a first threshold and the park brake sensor detects a position of the park brake that satisfies a second threshold.

17. The work machine of claim 16, further comprising:

a second pump fluidly coupled to the hydraulic circuit;

a second control valve fluidly coupled to the second pump and hydraulic circuit, the second control valve being in electrical communication with the controller, where the second control valve is controllably movable between at least a first position and a second position based on an electrical command from the controller; and a second implement for performing a second work function, the second implement being in fluid communication with the second control valve;

wherein, the warmup function is executable by the processor to electronically command the second pump to its full pressure setting, receive a command from the user control to control a movement of the second implement, controllably move the second control valve between its first position and its second position to allow hydraulic fluid to flow from the second pump to the second implement, and actuate the second implement in accordance with the command from the user control.

* * * * *